US005573237A

United States Patent [19]

Van Nimwegen et al.

[11] Patent Number: 5,573,237

[45] Date of Patent: Nov. 12, 1996

[54] TELESCOPING POLE BASKETBALL STANDARD

[75] Inventors: Edward G. Van Nimwegen, North Ogden; David C. Winter, Layton, both of Utah

[73] Assignee: Lifetime Products, Inc., Clearfield, Utah

[21] Appl. No.: 275,779

[22] Filed: Jul. 15, 1994

Related U.S. Application Data

[63] Continuation-in-part of Ser. No. 191,339, Feb. 3, 1994, Pat. No. 5,375,835, which is a continuation-in-part of Ser. No. 100,054, Jul. 30, 1993, Pat. No. 5,354,049, which is a continuation-in-part of Ser. No. 13,611, Feb. 4, 1993, Pat. No. 5,248,140.

[51] Int. Cl.[6] ..... A63B 63/08

[52] U.S. Cl. ..... 273/1.5 R; 218/161; 403/109; 403/379

[58] Field of Search ..... 273/1.5 R, 1.5 A; 248/161, 408, 411, 410, 157, 4007; 403/379, 109; 411/166

[56] References Cited

U.S. PATENT DOCUMENTS

| | | | |
|---|---|---|---|
| 966,949 | 8/1910 | Posson | 411/166 X |
| 1,130,831 | 3/1915 | Madell | 248/410 |
| 1,822,657 | 9/1931 | Horton | 411/166 |
| 1,926,674 | 10/1933 | Gross | 273/1 |
| 2,189,495 | 2/1940 | Lucia | 403/379 |
| 2,733,885 | 2/1956 | Brown et al. | 248/161 |
| 2,851,819 | 9/1958 | Weir | 248/157 |
| 2,898,065 | 8/1959 | Ackley | 248/40 |
| 3,017,183 | 1/1962 | Chalcroft | 273/1.5 |
| 3,025,058 | 3/1962 | Brumfield | 273/1.5 |
| 3,094,303 | 3/1962 | Belger | 248/40 |
| 3,161,395 | 12/1964 | Carter | 248/354 |
| 3,427,025 | 2/1969 | Procter | 273/1.5 |
| 3,469,870 | 9/1969 | Barkus | 287/58 |
| 3,495,794 | 2/1970 | Polk, Jr. | 48/157 |
| 3,510,131 | 5/1970 | Gardner | 248/161 X |
| 3,697,103 | 10/1972 | Mostyn | 287/58 |
| 3,900,194 | 8/1975 | Ward et al. | 272/1 |

(List continued on next page.)

FOREIGN PATENT DOCUMENTS

| | | | |
|---|---|---|---|
| 471103 | 1/1951 | Canada | 248/161 |
| 755442 | 11/1933 | France | 403/85 |
| 52440 | 4/1944 | France | 403/379 |
| 1341549 | 9/1963 | France | 273/1.5 R |
| 55963 | 8/1922 | Sweden | 248/161 |
| 520656 | 10/1939 | United Kingdom | 273/1.5 R |

OTHER PUBLICATIONS

DP, "Owner's Manual".
Fisher Price, "Adjustable Basketball Standard," Jun. 1993.
Little Tikes, "Adjustable Basketball Standard," Jun. 1993.
Today's Kids, "Adjustable Basketball Standard," Jul. 1992.

*Primary Examiner*—Paul E. Shapiro
*Attorney, Agent, or Firm*—Madson & Metcalf

[57] ABSTRACT

An adjustable basketball standard which may be assembled with a conventional backboard and goal to form a portable basketball system is disclosed. Embodiments include either a pole alone or the pole and a hollow ballast-receiving base which supports the pole. The pole includes a tubular inner pole section, a tubular outer pole section, and at least two fasteners. In the assembled system, the fasteners normally hold the inner pole section in a fixed position relative to the outer pole section. However, the fasteners may be released to permit telescopic movement of the inner pole section inside the outer pole section to change the pole's height. An insertion end of the inner pole section has an outwardly extending flare which acts as a bearing. The flare also works with a neck on the outer pole section to prevent accidental removal of the inner pole section. The outer pole section includes a base pole section and a middle pole section connected by a permanent fastener-free pole joint. Each fastener includes a bolt with a head and a non-circular shoulder, and a knob having a nut for engaging the threaded end of the bolt. Spaced apart bolt holes in the inner and outer pole sections receive and retain the bolts to fix the pole at a selected height.

42 Claims, 7 Drawing Sheets

U.S. PATENT DOCUMENTS

| | | | |
|---|---|---|---|
| 4,145,044 | 3/1979 | Wilson et al. | 273/1.5 |
| 4,412,679 | 11/1983 | Mahoney et al. | 273/1.5 |
| 4,685,129 | 8/1987 | Andersen et al. | 273/1.5 |
| 4,759,545 | 7/1988 | Grable | 273/1.5 |
| 5,098,092 | 3/1992 | Aakre et al. | 273/1.5 |
| 5,158,281 | 10/1992 | Williams | 273/1.5 |
| 5,191,852 | 3/1993 | Rupp | 114/255 |
| 5,207,407 | 4/1993 | Fitzsimmons et al. | 273/1.5 R X |
| 5,248,140 | 9/1993 | Matherne et al. | 273/1.5 R |
| 5,259,612 | 11/1993 | Matherne et al. | 273/1.5 R |

36
40
42

36
42
30
38

32
124
124
124
124
124
30
124
120
36
38

32
34
30
38
36

32
124
124
124
124
124
30
124
120
36
38

TELESCOPING POLE BASKETBALL STANDARD

RELATED U.S. APPLICATIONS

This application is a continuation in part of patent application Ser. No. 08/191,339 filed Feb. 3, 1994 now U.S. Pat. No. 5,375,835 and entitled TELESCOPING POLE PORTABLE BASKETBALL SYSTEM, which is a continuation-in-part of patent application Ser. No. 08/100,054 filed Jul. 30, 1993 now U.S. Pat. No. 5,354,049 and entitled APPARATUS AND METHOD FOR PACKAGING A PORTABLE BASKETBALL SYSTEM, which is a continuation-in-part of patent application Ser. No. 08/013,611, filed Feb. 4, 1993, now issued as U.S. Pat. No. 5,248,140 and entitled APPARATUS AND METHOD FOR PACKAGING A BASKETBALL GOAL SYSTEM WITH WEIGHT-FILLABLE BASE. The foregoing applications and patent are incorporated herein by reference.

FIELD OF THE INVENTION

The present invention relates to an adjustable basketball standard for use in a portable basketball system, and more particularly to a hollow ballast-receiving base which is connectable to a mechanically simple telescoping pole that may be secured at different lengths for placing a basketball goal and backboard at different predetermined heights.

TECHNICAL BACKGROUND OF THE INVENTION

As the game of basketball has increased in popularity, a greater number of people have purchased basketball systems for use at their homes. Such basketball systems typically include a standard to which a backboard and a goal are secured so that the goal is suspended above a playing surface. Although some basketball systems are permanently mounted into the ground near the home, or to the home itself, portable basketball systems are increasingly used. The advantages of portable basketball systems relative to permanently installed systems in general, and the relative merits of different portable basketball systems in particular, are discussed in patent applications Ser. No. 08/100,054 and 08/191,339, and in U.S. Pat. No. 5,248,140; those discussions are incorporated herein by reference.

In either a portable or a permanently installed basketball system, it may be desirable to adjust the height of the goal above the playing surface. For instance, the basketball system may be used by relatively tall players for some games and by shorter players during other games. The basketball system may be used at different times by players of different strengths or skill levels. The basketball system may also be used for regulation play at one time and for "dunking practice" at another time.

One approach to facilitating height adjustment of basketball goals involves clamping the backboard to the pole with one or more U-shaped bolts which are drawn against the pole by nuts threaded onto the ends of the bolts. By loosening the nuts, sliding the backboard along the pole, and re-tightening the nuts, one may alter the height of the goal. U-bolts are mechanically simple and therefore easy to manufacture and maintain.

However, bolting the backboard to the pole with U-bolts has several disadvantages when the time comes to adjust the goal's height. A wrench of the proper size is required to loosen and tighten the nuts. The bolt threads in outdoor systems may be exposed to deterioration from weathering. The bolts sliding along the pole tend to scratch the surface of the pole, marring its appearance and increasing its vulnerability to rust. Once the nuts are loosened, it may also be difficult to position the backboard at desired height. Two or more people may be required: one to loosen and then tighten the nuts, and a second to move the backboard and then hold it in the desired position.

Another approach to basketball goal height adjustment includes positioning a set bolt in a threaded hole in an outer length of pole, and positioning an inner length of pole telescopically within the outer length of pole. When the set bolt is tightened, the end of the set bolt presses against the outer surface of the inner length of pole.

Like U-bolts, set bolt adjustment systems are mechanically simple. However, the set bolt approach also has several disadvantages. The threads on the set bolt may be damaged, or the set bolt may scratch the inner length of pole, particularly where the end of the set bolt is forced against the inner length of pole to hold the goal at a particular height. If the inner pole slips against the set bolt, the set bolt may create a long scratch in the inner pole's surface.

A somewhat similar approach includes positioning one or more retaining pins through holes placed in both the inner and outer lengths of a telescoping pole. Because the pin goes through the inner pole length rather than resting against the outside surface of the inner pole, the risk of marring the inner pole is greatly reduced. Retaining pins, and cotter pins for securing them, are mechanically simple.

However, once they are removed, the retaining pin and the cotter pin are loose pieces which may easily be lost. Pliers or other supplemental tools may also be needed to remove or replace the cotter pin. Moreover, the protruding pins may create a risk of injury to players or basketballs.

Another method for adjusting the height of a telescoping pole is disclosed in U.S. Pat. No. 5,098,092 issued to Aakre et al. A threaded extension shaft is connected via gears to a crankshaft having a handle. Rotation of the handle turns the gears, which turn the threaded extension shaft, thereby extending or retracting a portion of the basketball pole. In addition to its complexity, a principal drawback of this approach is the weight of the extension shaft, gears, and related hardware. Lightweight portable basketball systems are preferable because they are more convenient and less expensive to ship, to position after assembly, and to store than heavier systems.

Telescoping poles of various designs have the advantage of permitting changes in the total height of the basketball system. Unlike U-bolt or other systems which employ a pole of fixed length, in a telescoping pole system the length of the pole decreases as the backboard moves down toward the playing surface. Thus, it may be possible to position a telescoping pole basketball system inside a garage or shed for indoor play during inclement weather.

Another approach to facilitating height adjustment positions a parallelogram-shaped structure between the backboard and the pole. Such an approach is disclosed in U.S. Pat. No. 4,805,904 issued to Nye. Use of the parallelogram structure is preferable to the U-bolt and set bolt approaches described above, because there are no threads to damage and little risk of marring the pole finish. There are also no loose retaining pins to be lost.

However, the parallelogram structure contains several interacting braces which add to the manufacturing cost, weight, and complexity of the basketball system. As noted, the parallelogram approach, unlike the telescoping pole approach, also fails to decrease the height of the overall basketball system as the backboard is lowered.

Thus, it would be an advancement in the art to provide a mechanically simple height-adjustable basketball standard for use in a basketball system.

It would be a further advancement in the art to provide such a basketball standard wherein the height adjustment mechanism does not add substantially to the total weight of the system.

It would also be an advancement in the art to provide such a basketball standard which does not require the use of a wrench or other additional tool for height adjustment.

It would be a related advancement to provide such a basketball standard which does not involve threads exposed to potential damage or rust.

It would be a further advancement to provide such a basketball standard which allows adjustment of the total height of the system.

Such a height-adjustable basketball standard is disclosed and claimed herein.

BRIEF SUMMARY OF THE INVENTION

The present invention provides an adjustable basketball standard which may be assembled with a backboard and a goal to form a portable basketball system. A conventional goal (also known as a "hoop") is attached to the backboard.

In a presently preferred embodiment, the basketball standard includes a pole and a base which supports the pole. The pole includes a tubular inner pole section, a tubular outer pole section, and at least two fasteners which may be assembled with the pole sections to form the pole. In the assembled system, the fasteners normally hold the inner pole section in a fixed position relative to the outer pole section. However, the fasteners may be released to permit telescopic movement of the inner pole section inside the outer pole section to change the pole's height. One end of the inner pole section, known as the backboard end, is connectable to the backboard so that changing the pole's height changes the height of the basketball goal above the playing surface.

The other end of the inner pole section, which is known as the insertion end, has an outwardly extending flare. The flare includes four outward projections which are spaced evenly about the circumference of the inner pole section and which are connected by circular-arc-shaped portions of the inner pole section. The flare works together with a neck on the outer pole section to prevent accidental removal of the inner pole section from within the outer pole section. The flare also acts as a bearing during telescopic movement of the inner pole section within the outer pole section.

In the assembled system the inner pole section is positioned within the outer pole section's top end. The opposite end of the outer pole section is connected to the base. In order to permit telescoping movement of the inner pole section within the outer pole section, a substantial portion of the outer pole section has an inner diameter that is larger than the outer diameter of the inner pole section. However, the outer pole section also has an inwardly extending neck near its top end. The neck has an inner diameter less than the outer diameter of the inner pole section's flare. The neck is formed by a pair of inward depressions which are spaced evenly about the circumference of the outer pole section and which are connected by circular-arc-shaped portions of the outer pole section.

In this preferred embodiment, the outer pole section includes a base pole section and a middle pole section. In the assembled system, the base pole section is connected to the middle pole section by a permanent fastener-free pole joint. The other end of the base pole section is connected to the base.

The fasteners are configured to releasably engage bolt holes in the inner and outer pole sections, thereby releasably securing the inner pole section in position relative to the outer pole section. The inner pole section has a plurality of bolt guides located at successive positions approximately six inches apart along its length. Each bolt guide includes a region of the inner pole section having a pair of opposing bolt holes. The outer pole section also has at least two spaced apart fastener sites adjacent its top end. Each of the fastener sites includes a region of the outer pole section which has a pair of opposing bolt holes.

Each fastener includes a bolt and a knob. The bolt has a head extending outwardly from a shaft and has a non-circular shoulder. The shaft has a threaded end distal from the head. The knob includes a molded high-density polyethylene handle which is press-fit around a nut that is capable of threadably engaging the threaded end of the shaft. The outer surface of the polyethylene has ridges to facilitate gripping and rotating the knob in order to rotate the nut so that the fastener can be released or secured without the use of a wrench or other supplemental tool.

To prevent the bolt from rotating together with the nut, the outer pole section also includes a bolt retainer with a non-circular cavity positioned adjacent at least one of the bolt holes. The cavity receives and retains the non-circular bolt shoulder to prevent rotation of the bolt about the longitudinal axis of its shaft.

The base is a hollow ballast-receiving base capable of assembly with the pole, the backboard, and the goal to form the portable basketball system. In the assembled system, the base rests on a floor, driveway, or other playing surface and supports the pole. The pole is supported in a stationary, substantially upward but nonetheless inclined position. The base is connected to the outer pole section near that section's base end.

In the assembled system the inner pole section is movable among a plurality of predetermined positions by telescoping movement within the outer pole section. The various pole lengths give the portable basketball system goal heights in the range from about seven-and-one-half feet to about ten feet. Thus, the system may be shortened enough for use indoors during inclement weather.

The pole may be fixed in position by aligning selected bolt holes of the inner section with the bolt holes of the outer section, placing portions of the bolt shafts within the aligned bolt holes, positioning the bolt heads so they are retained by the bolt retainer cavities, threadably engaging the threaded ends of the bolts with the knob nuts. Once the system is assembled and positioned with the pole in a stationary, substantially upward inclined position, the bolt shafts resist removal by hand from the bolt holes.

To adjust the pole's length, the pole is reclined by tilting the base away from stable contact with the playing surface until the pole reaches a generally horizontal position. In such a horizontal position, the bolt shafts do not substantially resist removal by hand. The knobs are rotated to disengage their nuts from the corresponding bolts, which may then be pushed out of the bolt holes. Next, the inner pole section is moved telescopically within the outer pole section until different bolt holes align and the pole has the desired length. Finally, the bolts are placed through the aligned bolt holes, the nuts are replaced on the bolts, and the system is tilted back up until the base rests once again on the playing surface and the pole is substantially upright.

Thus, the fasteners and telescoping pole sections of the present invention provide a mechanically simple height-adjustable basketball standard. The fasteners add very little to the total weight of the portable basketball system. In addition, the knob and nut substantially cover the threaded end of the shaft and thus reduce the risk of damage in comparison to exposed thread systems such as those employing U-bolts.

The basketball standard of the present invention is capable of disposition for packaging and shipping within an outer relatively flat shipping container. The base preferably has an exterior contour for receiving and retaining the pole sections within such a container and impeding shifting movement of the pole sections within the container during shipping.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
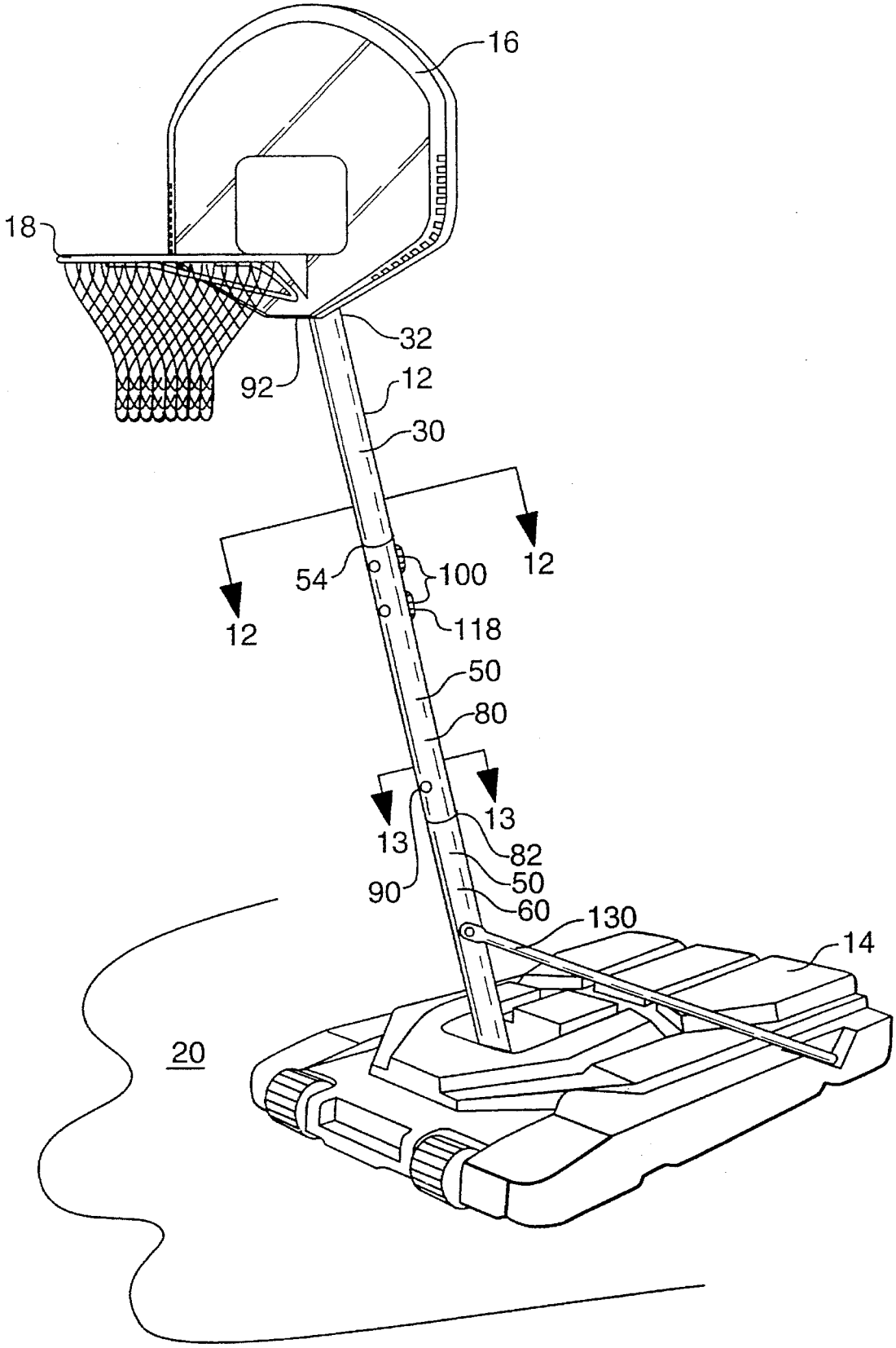
FIG. 1 is a perspective view of an embodiment of the present invention illustrating an inner pole section, an outer pole section formed from a middle pole section and a base pole section, fasteners, and a base assembled into a basketball standard of an assembled portable basketball system.

Reference is now made to the figures wherein like parts are referred to by like numerals. The present invention relates to a height-adjustable basketball standard. A presently preferred portable embodiment of the invention, designated generally at 10 in FIG. 1, is intended for use in portable basketball systems and thus comprises a basketball standard which includes both a telescoping pole 12 and a portable base 14 for supporting the pole 12. Other embodiments of the invention, which are preferred for permanent installations, include a telescoping pole but contain no portable base.

The assembled portable basketball system includes a backboard 16 mounted on the pole 12. The backboard 16 may be a conventional backboard, or it may be a backboard such as the molded light-weight basketball backboard disclosed in my concurrently filed application entitled BASKETBALL BACKBOARD. A conventional basketball goal 18 is mounted on the backboard 16. The pole 12 thus suspends the backboard 16 and the goal 18 at a distance above a playing surface 20.

The pole 12 includes a tubular inner pole section 30 which is positioned in telescopic engagement within a tubular outer pole section 50. The inner pole section 30 has a backboard end 32 which is connected to the backboard 16. Thus, changing the height of the telescoping pole 12 changes the height of the basketball goal 18 above the playing surface 20.

Figures 3, 4, 5, 6, 7:
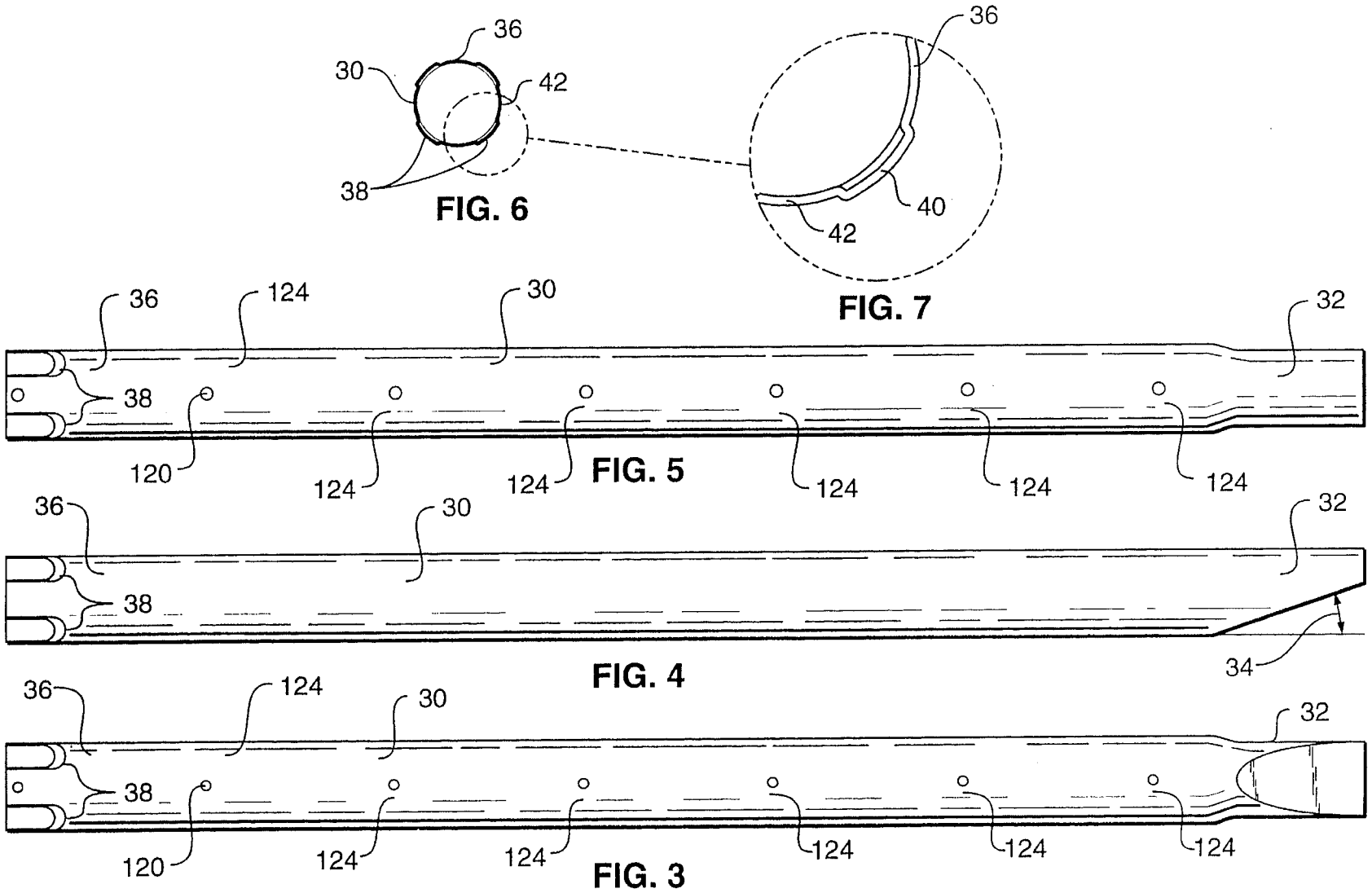
FIG. 3 is a front plan view of the inner pole section shown in FIG. 2.
FIG. 4 is a side plan view of the inner pole section.
FIG. 5 is a rear plan view of the inner pole section.
FIG. 6 is an end view illustrating a flange located near one end of the inner pole section.
FIG. 7 is an enlarged view of a portion of the flange shown in FIG. 6.

As illustrated best in FIGS. 1 and 4, the backboard end 32 of the inner pole section 30 is beveled such that the pole 12 is inclined away from the base 14 when the backboard 16 is vertical. It is presently preferred that the bevel angle 34 on the backboard end 32 of the pole 12 be in the range from about ten to about fifteen degrees, and most preferably be about eleven degrees. The pole 12 preferably leans forward at the same angle from the vertical. Thus, the base 14 is positioned away from the region of the playing surface 20 that is directly below the goal 18, thereby reducing the risk of injury due to a collision between a player and the basketball system.

As shown in FIGS. 3 through 7, the inner pole section 30 also has an insertion end 36 which includes an outwardly extending flare 38. The flare 38 includes four outward projections 40 which are spaced evenly about the circumference of the inner pole section 30. The projections 40 are connected by circular-arc-shaped portions 42 of the inner pole section 30. The projections 40 are preferably formed by swaging the insertion end 36 of the inner pole section 30. In the preferred embodiment illustrated, the projections extend about 90 thousandths of an inch out from the pole section 30, and each projection spans about 32 degrees of arc. However, other embodiments may have other dimensions.

Figure 12:
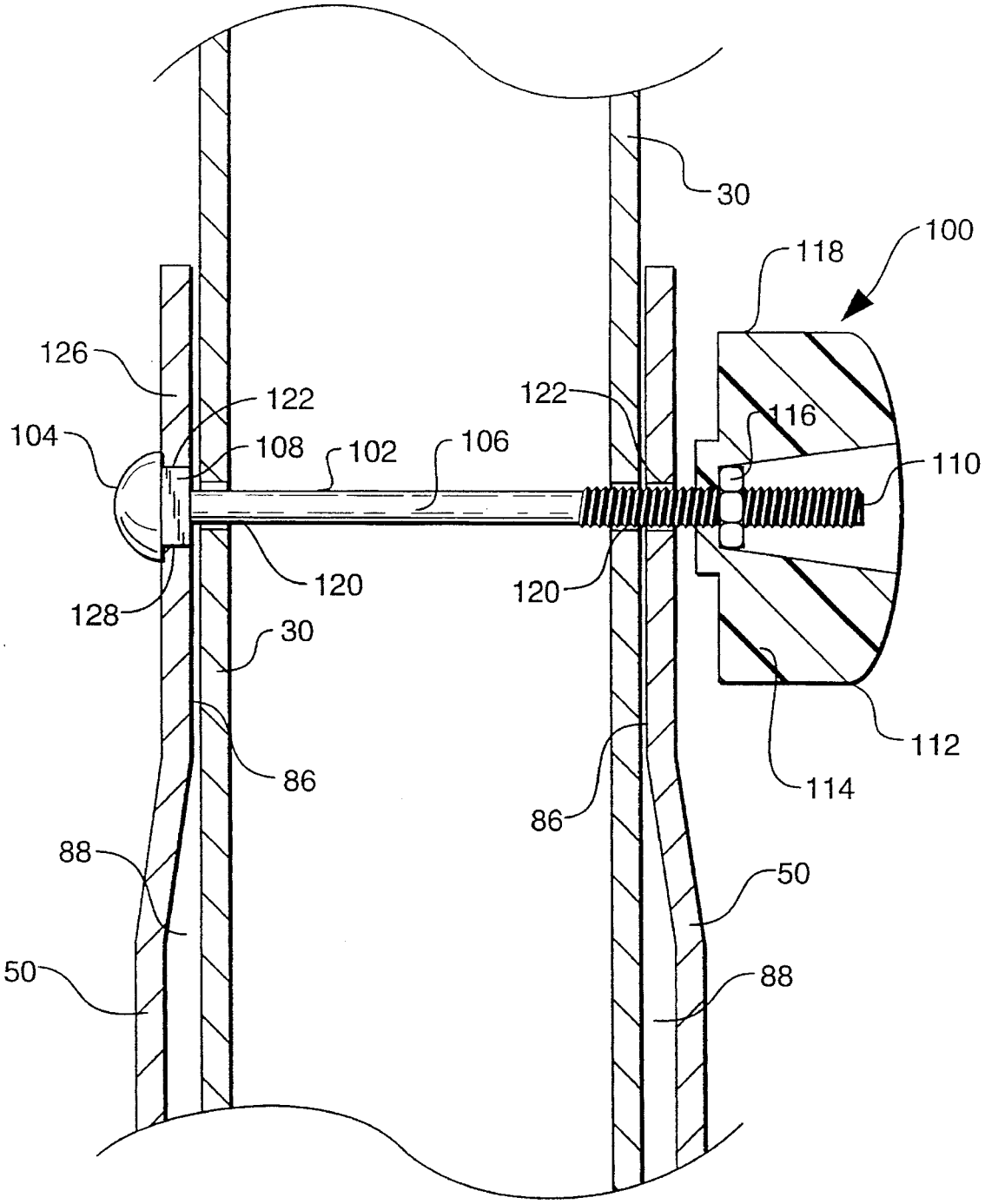
FIG. 12 is a partial cross-sectional view taken along line 12—12 in FIG. 1, further illustrating the fastener, the inner pole section, and the outer pole section.

In the assembled system the inner pole section 30 is positioned within the outer pole section 50, as shown in FIGS. 1 and 12. In order to permit telescoping movement of the insertion end 36 (FIG. 3) of the inner pole section 30 within the outer pole section 50 to adjust the length of the pole 12, a substantial portion of the outer pole section 50 has an inner diameter that is larger than the outer diameter of the inner pole section 30.

Figure 10:
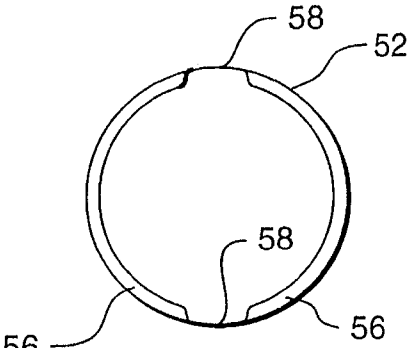
FIG. 10 is an end view illustrating a neck located near one end of the middle pole section.
Figure 9:
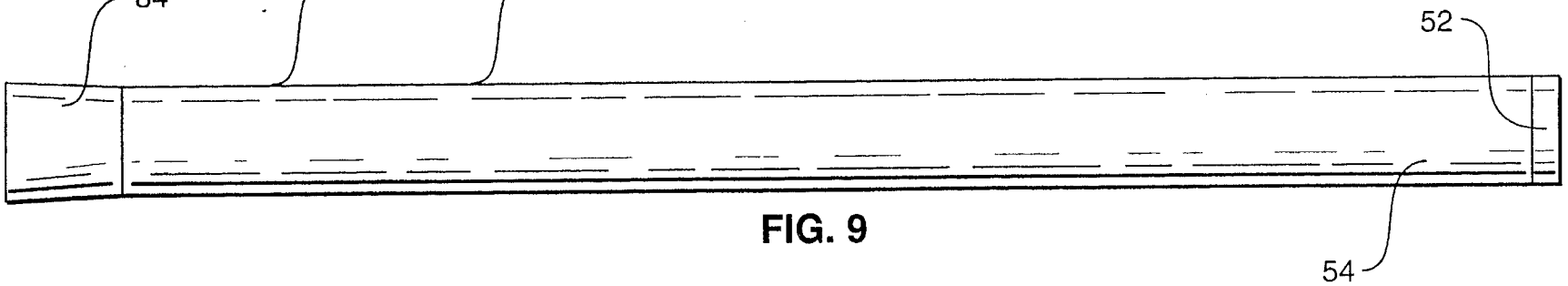
FIG. 9 is a side plan view of the middle pole section.
Figure 8:
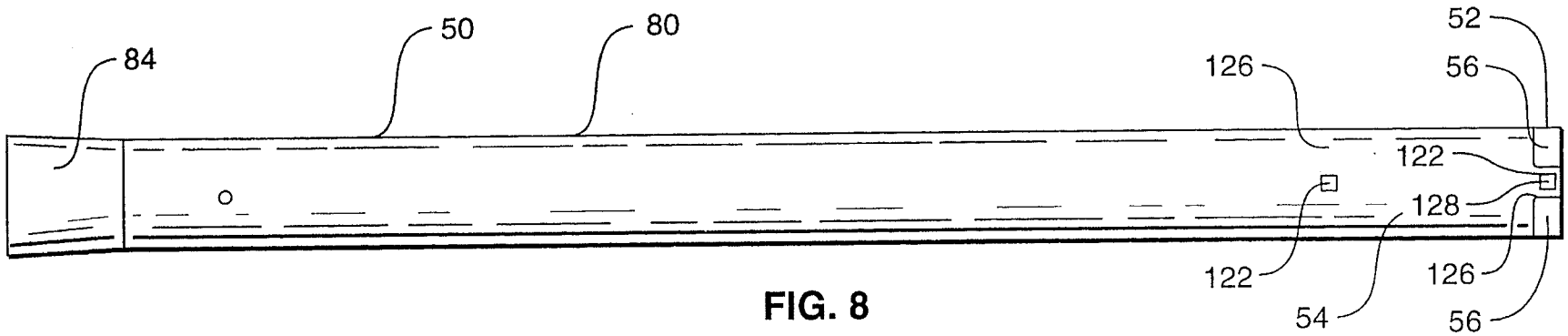
FIG. 8 is a front plan view of the middle pole section shown in FIG. 2.

However, as shown in FIGS. 8 through 10, the outer pole section 50 also has an inwardly extending neck 52 near its top end 54. The neck 52 has an inner diameter which is less than the outer diameter of the inner pole section's flare 38 (FIG. 5). In the preferred embodiment shown, the neck's inner diameter is about 50 thousandths of an inch smaller than the flare's outer diameter, but this may vary in other embodiments.

The neck 52 is formed by a pair of inward depressions 56 which are spaced evenly about the circumference of the outer pole section 50 and which are connected by circular-arc-shaped portions 58 of the outer pole section 50. The depressions 56 are preferably formed by swaging the top end 54 of the outer pole section 50.

The neck 52 also acts as a slider 86 which is positioned at the top end 54 of the outer pole section 50 adjacent the inner pole section 30. The slider 86 is a load-bearing component which reduces binding during telescoping movement of the inner pole section 30 within the outer pole section 50. The inner pole section 30 rests and slides against the slider 86, which spans a gap 88 between the pole sections 30, 50. In an alternative embodiment, the slider 86 may be formed of nylon or a similar material rather than including a swaged metal portion of the outer pole section 50. In the preferred embodiment illustrated, the flare 38 (FIG. 5) also acts as a bearing during telescopic movement of the inner pole section 30 within the outer pole section 50.

In the preferred embodiment shown in FIG. 1, the outer pole section 50 includes a base pole section 60 and a middle pole section 80. Alternative embodiments may employ an outer pole section 50 formed from one or more constituent pole sections. In the assembled system, the base pole section 60 is connected to the middle pole section 80 by a joint 82. The joint 82 may be a conventional joint formed with threads, bolts, or other joining means.

Figure 13:
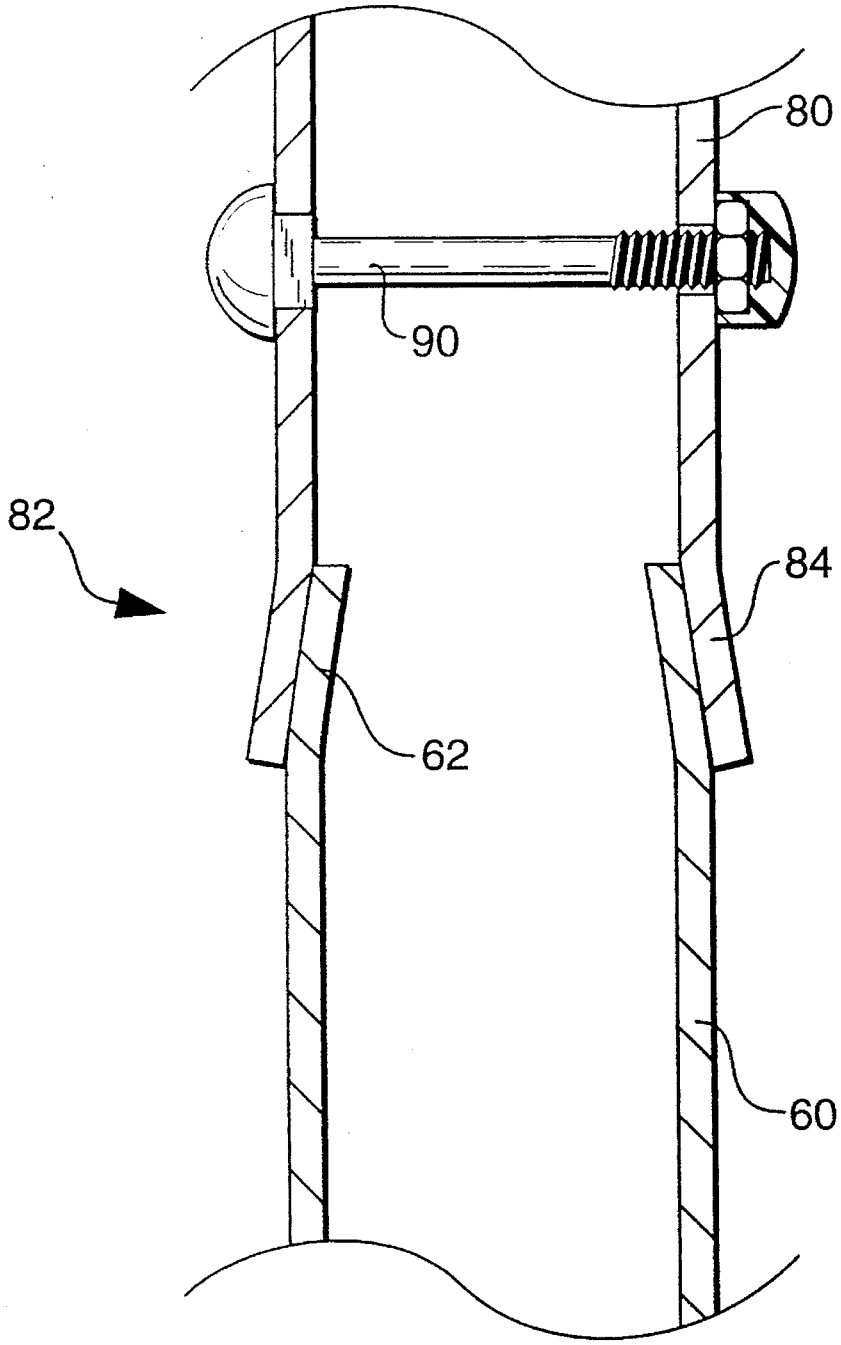
FIG. 13 is a partial cross-sectional view taken along line 13—13 in FIG. 1, further illustrating the middle pole section and the base pole section.

With reference to FIGS. 1 and 13, however, the joint 82 is preferably not a quick-release joint or another type of joint that might result in accidental disengagement of the middle pole section 80 from the base pole section 60 during play or during relocation of the base 14. Thus, the joint 82 is preferably a permanent fastener-free pole joint such as the joint illustrated in FIG. 13 or the joints described in U.S. Pat. No. 5,090,837 issued to Mower, which is incorporated herein by reference. The joint 82 includes a male component 62 which engages a corresponding female component 84. Once assembled, the joint 82 resists disassembly and lateral deflection of the pole sections 60, 80 and provides for long service even under rigorous use, A stop bolt 90 is positioned near the joint 82 as shown in FIG. 13. With reference to FIGS. 1, 3, and 13, the stop bolt 90 is positioned such that the insertion end 36 of the inner pole section 30 encounters the stop bolt 90 before telescopic movement shortens the pole 12 sufficiently for the bottom 92 of the backboard 16 to reach the top end 54 of the outer pole section 50. Thus, a user's hand will not be pinched between the backboard 16 and the outer pole section 50.

With continued reference to FIG. 1, the pole 12 also includes two fasteners 100 which are assembled with the pole sections 30 and 50 to form the pole 12. In the assembled system, the fasteners 100 normally hold the inner pole section 30 in a fixed position relative to the outer pole section 50. However, the fasteners 100 may be released to permit telescopic movement of the inner pole section 30 inside the outer pole section 50 to change the pole's height.

As shown in FIGS. 1 and 12, each fastener 100 includes a bolt 102. The bolt 102 has a head 104 extending outwardly from a shaft 106. A shoulder 108 adjacent the head 104 is non-circular. The shaft 106 has a threaded end 110 distal from the head 104. The bolt 102 may be a conventional bolt, such as a carriage bolt with a dome-shaped head.

Each fastener 100 also includes a knob 112. The knob 112 includes a molded handle 114 which is pressed around a conventional nut 116. The nut 116 is capable of threadably engaging the threaded end 110 of the shaft 106. The handle 114 is preferably molded out of high-density polyethylene or a similar light-weight rugged material. The outer surface 118 of the handle 114 has ridges to facilitate gripping and rotating the knob 112 in order to rotate the nut 116.

As shown best in FIG. 12, each fastener 100 is configured to releasably engage bolt holes 120 in the inner pole section 30 and to simultaneously engage aligned bolt holes 122 in the outer pole section 50. As further illustrated in FIGS. 3 and 5, the inner pole section 30 has a plurality of bolt guides 124 located at successive positions along its length. Each bolt guide 124 includes a region of the inner pole section 30 having a pair of opposing bolt holes 120. In the preferred embodiment illustrated, the bolt holes 120 are spaced along the length of the inner pole section 30 at intervals of approximately six inches, but alternative embodiments of the present invention may employ different spacings.

As shown in FIGS. 8 and 12, the outer pole section 50 has at least one fastener site 126 adjacent its top end 54. The preferred embodiment illustrated has two spaced apart fastener sites 126 to provide greater stability, but alternative embodiments may employ one or more fastener sites 126. Each of the fastener sites includes a region of the outer pole section 50 which has a pair of opposing bolt holes 122.

In the preferred embodiment illustrated, one of the bolt holes 122 is a non-circular cavity 128, as shown best in FIG. 8. In an alternative embodiment, the bolt hole 122 and the cavity 128 do not coincide, but are rather adjacent to one another. In either embodiment, the walls of the cavity 128 form a bolt retainer capable of preventing the bolt 102 from rotating. The cavity 128 receives and retains the non-circular shoulder 108 to prevent rotation of the bolt 102 about the longitudinal axis of its shaft 106.

Figure 11:
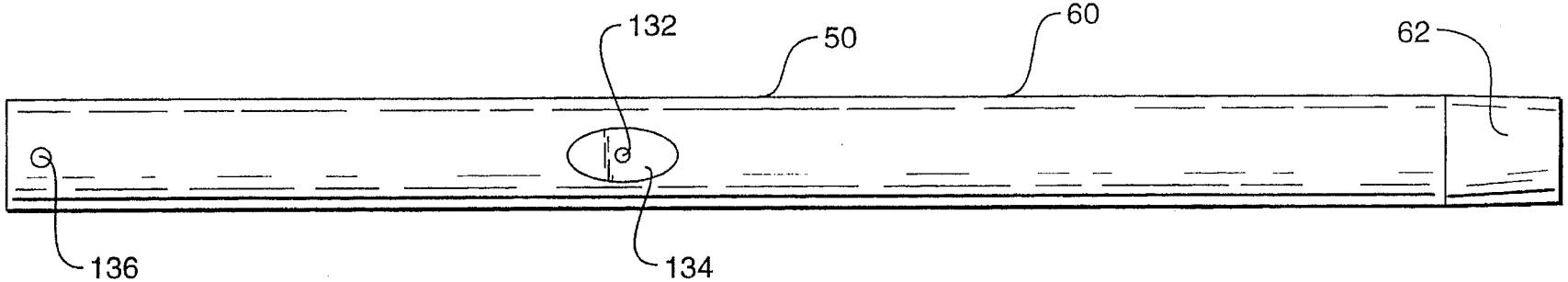
FIG. 11 is a side plan view of the base pole section shown in FIG. 2.

With reference now to FIGS. 1 and 11, the base 14 is preferably a hollow ballast-receiving base capable of assembly with the pole 12, the backboard 16, and the goal 18 to form the portable basketball system. In the assembled system, the base 14 is connected to the outer pole section 50 by a pair of braces 130. A pin (not shown) passes through the braces 130 and through an aperture 132 in a dimpled region 134 on each side of the base pole section 60. The base pole section 60 is also pivotally secured to the base 14 by a pin (not shown) through another pair of apertures 136. The method and manner for connection of the base 14, the braces 130, and the pole 12 are further described in co-owned and copending patent application Ser. No. 08/191,339 filed Feb. 3, 1994 and entitled TELESCOPING POLE PORTABLE BASKETBALL SYSTEM, which is incorporated herein by reference.

Figure 2:
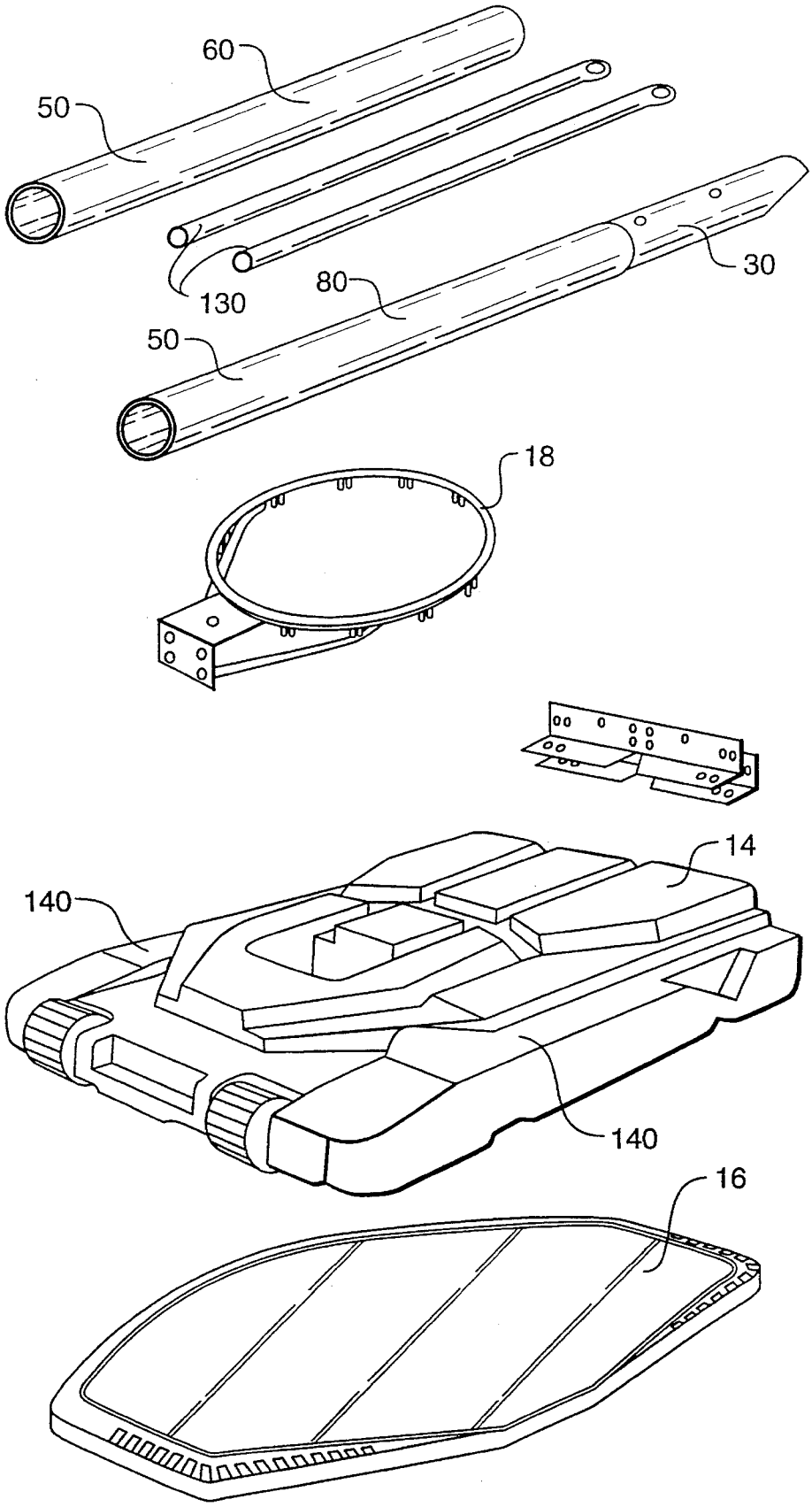
FIG. 2 is an exploded perspective view of a disassembled basketball standard according to the present invention, illustrating the pole sections, base, and other components of the portable basketball system shown in FIG. 1 positioned relative to one another for packaging in a relatively flat container (not shown).

As illustrated in FIG. 2, the basketball standard of the present invention is capable of disposition for packaging and shipping within an outer relatively flat container (not shown) such as a shipping carton having a depth of about 12 inches or less. To facilitate such disposition, the base 14 preferably has an exterior contour for receiving and retaining the pole sections 30, 60, and 80 within the container and impeding shifting movement of the pole sections 30, 60, and 80 within the container during shipping. Thus, the base 14 has notches 140 for receiving the pole sections 30, 60, and 80. Alternative embodiments may match the pole sections to the notches 140 differently, may position the notches 140 differently in the contour of the base 14, or may position one or more pole sections 30, 60, 80 or braces 130 inside the hollow base 14.

In operation, the assembled basketball pole 12 shown in FIG. 1 is height-adjustable. The inner pole section 30 is movable among a plurality of predetermined positions by telescoping movement within the outer pole section 50. The various pole lengths give the portable basketball system goal heights above the playing surface 20 in the range from about seven-and-one-half feet to about ten feet. The pole 12 is preferably capable of being fixed at a length which gives the portable basketball system a total height less than about nine feet. Thus, the system may be shortened enough for use indoors during inclement weather.

With reference to FIGS. 1 and 12, when the assembled system is positioned as shown with the pole 12 in a stationary, substantially upward inclined position, the bolt shafts 106 resist removal by hand from the bolt holes 120, 122 even if the knobs 112 are rotated out of engagement with the bolts 102. Thus, to adjust the length of the pole 12, the pole 12 is reclined by tilting the base 14 away from stable contact with the playing surface 20 until the pole 12 reaches a generally horizontal position. In such a horizontal position, the bolt shafts 106 do not substantially resist removal by hand because the shafts 106 no longer bear a significant portion of the weight of the inner pole section 30 and the backboard 16 and goal 18. The knobs 112 are then rotated to disengage their nuts 116 from the corresponding bolts 102, which may then be pushed out of the bolt holes 120, 122.

Next, the inner pole section 30 is moved telescopically within the outer pole section 50 until selected bolt holes 120 of the inner section 30 are aligned with the bolt holes 122 of the outer section 50 such that the pole 12 has the desired length. Then portions of the bolt shafts 106 of the fasteners 100 are placed within the aligned bolt holes 120, 122. The bolt heads 104 are positioned such that they are retained by the bolt retainer cavities 128. Then the nut 116 is positioned to threadably engage the threaded end 110 of each bolt 102 and the knob 112 is rotated until it abuts the outer pole section 50. Finally, the system is tilted back up until the base 14 rests once again on the playing surface 20 and the pole 12 is substantially upright.

With reference to FIGS. 1, 5, and 8, the flare 38 works together with the neck 52 to prevent accidental removal of the inner pole section 30 from within the outer pole section 50 during height-adjustment. Such removal is undesirable because the base 14, freed of the counteracting weight of the inner pole section 30, the backboard 16, and the goal 18, may thrust the top end 54 of the outer pole section 50 suddenly upward.

In summary, the fasteners and telescoping pole sections of the present invention provide a mechanically simple height-adjustable basketball standard. Mechanical complexities associated with other approaches to height adjustment have been eliminated. In addition, the fasteners add very little to the total weight of the portable basketball system. The knob and nut also substantially cover the threaded end of the shaft and thus reduce the risk of damage in comparison to exposed thread systems such as those employing U-bolts.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. An adjustable basketball pole capable of assembly for use in a portable basketball system which includes a backboard, a goal attachable to the backboard, and a base, said basketball pole connectable to the backboard and to the base, said pole comprising a tubular inner pole section, a tubular outer pole section, and at least one fastener capable of assembly with said pole sections to form said pole;

said inner pole section having a backboard end and an insertion end, said inner pole section connectable to the backboard at said backboard end, said inner pole section having an outwardly extending flare adjacent said insertion end, said outwardly extending flare comprising a plurality of outward projections connected by substantially circular-arc-shaped portions of said inner pole section, said inner pole section having a plurality of bolt guides located at successive positions along the length of said inner pole section, each of said bolt guides comprising a region of said inner pole section having a pair of opposing bolt holes;

said outer pole section having a top end and a base end, said outer pole section connectable at said base end to the base, a substantial portion of said outer pole section having an inner diameter larger than the outer diameter of said inner pole section, an inwardly extending neck of said outer pole section adjacent said top end having an inner diameter less than the outer diameter of said outwardly extending flare, said outer pole section having at least one fastener site adjacent said top end, said fastener site comprising a region of said outer pole section having a pair of opposing bolt holes;

said fastener configured to releasably engage at least four of said bolt holes to thereby secure said inner pole section in position relative to said outer pole section;

said basketball pole further characterized by said inner pole section being movable among a plurality of predetermined positions by telescoping movement within said outer pole section, said pole being fixable at a predetermined length if said bolt holes of said inner section and said bolt holes of said outer section are aligned and said fastener is placed at least partially within said aligned bolt holes.

2. The basketball pole of claim 1, wherein said outwardly extending flare comprises four outward projections spaced substantially evenly about the circumference of said inner pole section.

3. The basketball pole of claim 1, wherein said bolt guides are located at successive positions approximately six inches apart along the length of said inner pole section.

4. The basketball pole of claim 1, wherein said inwardly extending neck comprises a plurality of inward depressions connected by substantially circular-arc-shaped portions of said outer pole section.

5. The basketball pole of claim 4, wherein said inwardly extending neck comprises a pair of inward depressions spaced substantially evenly about the circumference of said outer pole section.

6. The basketball pole of claim 1, wherein said outer pole section comprises a base pole section connectable to the base and a middle pole section connectable to said base pole section, and said middle pole section comprises said inwardly extending neck.

7. The basketball pole of claim 6, wherein said base pole section is connectable to said middle pole section by a permanent fastener-free pole joint.

8. The basketball pole of claim 1, wherein said fastener comprises:

a bolt having a head extending outwardly from a shaft and having a non-circular shoulder adjacent said head, said shaft having a threaded end distal from said head; and a knob having a nut capable of threadably engaging said threaded end of said shaft, said knob further having an outer surface connected to said nut for gripping and rotating said nut.

9. The basketball pole of claim 8, wherein at least a portion of said head of said bolt is dome-shaped.

10. The basketball pole of claim 8, wherein said knob comprises high-density polyethylene disposed around at least a portion of said nut.

11. The basketball pole of claim 8, wherein said outer pole section further comprises a bolt retainer having a non-circular cavity positioned adjacent at least one of said bolt holes in said outer pole section, and said cavity is capable of receiving and retaining said non-circular shoulder of said bolt to prevent rotation of said bolt about the longitudinal axis of said shaft.

12. The basketball pole of claim 11, wherein said pole is fixable at a predetermined length if said bolt holes of said inner section and said bolt holes of said outer section are aligned, portions of said shaft of said bolt are placed within said aligned bolt holes, said bolt head is retained by said bolt retainer, and said knob nut threadably engages said threaded end of said bolt.

13. The basketball pole of claim 12, wherein said shaft substantially resists removal by hand from said aligned bolt holes if said pole is in a stationary, substantially upward inclined position, and said shaft does not substantially resist removal by hand from said aligned bolt holes if said pole is in a substantially horizontal position.

14. The basketball pole of claim 1, wherein said pole is fixable at a predetermined length which gives the portable basketball system a total height of less than about nine feet.

15. The basketball pole of claim 1, wherein said pole is fixable at a plurality of predetermined lengths which give the portable basketball system goal heights in the range from about seven-and-one-half feet to about ten feet.

16. An adjustable basketball standard capable of assembly for use in a portable basketball system which includes a backboard and a goal attachable to the backboard, said basketball standard comprising a pole and a base, said pole comprising a tubular inner pole section, a tubular outer pole section, and at least two fasteners capable of assembly with said pole sections to form said pole;

said inner pole section having a backboard end and an insertion end, said inner pole section connectable to the backboard at said backboard end, said inner pole section having an outwardly extending flare adjacent said insertion end, said outwardly extending flare comprising a plurality of outward projections connected by substantially circular-arc-shaped portions of said inner pole section, said inner pole section having a plurality of bolt guides located at successive positions along the length of said inner pole section, each of said bolt guides comprising a region of said inner pole section having a pair of opposing bolt holes;

said outer pole section having a top end and a base end, said outer pole section connectable at said base end to said base, a substantial portion of said outer pole section having an inner diameter larger than the outer diameter of said inner pole section, an inwardly extending neck of said outer pole section adjacent said top end having an inner diameter less than the outer diameter of said outwardly extending flare, said outer pole section having at least two spaced apart fastener sites adjacent said top end, each of said fastener sites comprising a region of said outer pole section having a pair of opposing bolt holes;

each of said fasteners configured to releasably engage at least four of said bolt holes to thereby secure said inner pole section in position relative to said outer pole section; and said base being a hollow ballast-receiving base capable of assembly with said pole and with the backboard and the goal to form the portable basketball system wherein said base supports said pole in a stationary, substantially upward inclined position and is connected to said outer pole section near said base end of said outer pole section;

said basketball standard further characterized by said inner pole section being movable among a plurality of predetermined positions by telescoping movement within said outer pole section, said pole being fixable at a predetermined length if said bolt holes of said inner section and said bolt holes of said outer section are aligned and said fasteners are placed at least partially within said aligned bolt holes.

17. The basketball standard of claim 16, wherein said outwardly extending flare comprises four outward projections spaced substantially evenly about the circumference of said inner pole section.

18. The basketball standard of claim 16, wherein said bolt guides are located at successive positions approximately six inches apart along the length of said inner pole section.

19. The basketball standard of claim 16, wherein said inwardly extending neck comprises a plurality of inward depressions connected by substantially circular-arc-shaped portions of said outer pole section.

20. The basketball standard of claim 19, wherein said inwardly extending neck comprises a pair of inward depressions spaced substantially evenly about the circumference of said outer pole section.

21. The basketball standard of claim 16, wherein said outer pole section comprises a base pole section connectable to said base and a middle pole section connectable to said base pole section, and said middle pole section comprises said inwardly extending neck.

22. The basketball standard of claim 21, wherein said base pole section is connectable to said middle pole section by a permanent fastener-free pole joint.

23. The basketball standard of claim 16, wherein each of said fasteners comprises:

a bolt having a head extending outwardly from a shaft and having non-circular shoulder adjacent said head, said shaft having a threaded end distal from said head; and a knob having a nut capable of threadably engaging said threaded end of said shaft, said knob further having an outer surface connected to said nut for gripping and rotating said nut.

24. The basketball standard of claim 23, wherein at least a portion of said head of said bolt is dome-shaped.

25. The basketball standard of claim 23, wherein said knob comprises high-density polyethylene disposed around at least a portion of said nut.

26. The basketball standard of claim 23, wherein said outer pole section further comprises a bolt retainer having a non-circular cavity positioned adjacent at least one of said bolt holes in said outer pole section, and said cavity is capable of receiving and retaining said non-circular shoulder of said bolt to prevent rotation of said bolt about the longitudinal axis of said shaft.

27. The basketball standard of claim 26, wherein said pole is fixable at a predetermined length if said bolt holes of said inner section and said bolt holes of said outer section are aligned, portions of said shafts of said bolts are placed within said aligned bolt holes, said bolt heads are retained by said bolt retainers, and said knob nuts threadably engage said threaded ends of said bolts.

28. The basketball standard of claim 27, wherein said shafts substantially resist removal by hand from said aligned bolt holes if said pole is in a stationary, substantially upward inclined position, and said shafts do not substantially resist removal by hand from said aligned bolt holes if said pole is in a substantially horizontal position.

29. The basketball standard of claim 16, wherein said pole is fixable at a predetermined length which gives the portable basketball system a total height of less than about nine feet.

30. The basketball standard of claim 16, wherein said pole is fixable at a plurality of predetermined lengths which give the portable basketball system goal heights in the range from about seven-and-one-half feet to about ten feet.

31. An adjustable basketball standard capable of disposition for packaging and shipping within an outer relatively flat container and capable of assembly for use in a portable basketball system which includes a backboard and a goal attachable to the backboard, said basketball standard comprising a pole and a base, said pole comprising a tubular inner pole section, a tubular outer pole section, and at least two fasteners capable of assembly with said pole sections to form said pole;

said inner pole section having a backboard end and an insertion end, said inner pole section connectable to the backboard at said backboard end, said inner pole section having an outwardly extending flare adjacent said insertion end, said outwardly extending flare comprising a plurality of outward projections connected by substantially circular-arc-shaped portions of said inner pole section, said inner pole section having a plurality of bolt guides located at successive positions along the length of said inner pole section, each of said bolt guides comprising a region of said inner pole section having a pair of opposing bolt holes;

said outer pole section having a top end and a base end, said outer pole section connectable at said base end to said base, a substantial portion of said outer pole section having an inner diameter larger than the outer diameter of said inner pole section, an inwardly extending neck of said outer pole section adjacent said top end having an inner diameter less than the outer diameter of said outwardly extending flare, said outer pole section having at least two spaced apart fastener sites adjacent said top end, each of said fastener sites comprising a region of said outer pole section having a pair of opposing bolt holes, said outer pole section comprising a base pole section connectable to said base and a middle pole section connectable to said base pole section, and said middle pole section comprising said inwardly extending neck, said base pole section being connectable to said middle pole section by a permanent fastener-free pole joint;

each of said fasteners configured to releasably engage at least four of said bolt holes to thereby secure said inner pole section in position relative to said outer pole section, each of said fasteners comprising:

a bolt having a head extending outwardly from a shaft and having a non-circular shoulder adjacent said head, said shaft having a threaded end distal from said head; and a knob having a nut capable of threadably engaging said threaded end of said shaft, said knob further having an outer surface connected to said nut for gripping and rotating said nut;

said base being a hollow ballast-receiving base capable of assembly with said pole and with the backboard and the goal to form the portable basketball system wherein said base supports said pole in a stationary, substantially upward inclined position and is connected to said outer pole section near said base end of said outer pole section; and said basketball standard further characterized by said inner pole section being movable among a plurality of predetermined positions by telescoping movement within said outer pole section, said pole being fixable at a predetermined length if said bolt holes of said inner section and said bolt holes of said outer section are aligned and said fasteners are placed at least partially within said aligned bolt holes.

32. The basketball standard of claim 31, wherein said outwardly extending flare comprises four outward projections spaced substantially evenly about the circumference of said inner pole section.

33. The basketball standard of claim 31, wherein said bolt guides are located at successive positions approximately six inches apart along the length of said inner pole section.

34. The basketball standard of claim 31, wherein said inwardly extending neck comprises a plurality of inward depressions connected by substantially circular-arc-shaped portions of said outer pole section.

35. The basketball standard of claim 34, wherein said inwardly extending neck comprises a pair of inward depressions spaced substantially evenly about the circumference of said outer pole section.

36. The basketball standard of claim 31, wherein at least a portion of said head of said bolt is dome-shaped.

37. The basketball standard of claim 31, wherein said knob comprises high-density polyethylene disposed around at least a portion of said nut.

38. The basketball standard of claim 31, wherein said outer pole section further comprises a bolt retainer having a non-circular cavity positioned adjacent at least one of said bolt holes in said outer pole section, and said cavity is capable of receiving and retaining said non-circular shoulder of said bolt to prevent rotation of said bolt about the longitudinal axis of said shaft.

39. The basketball standard of claim 38, wherein said pole is fixable at a predetermined length if said bolt holes of said inner section and said bolt holes of said outer section are aligned, portions of said shafts of said bolts are placed within said aligned bolt holes, said bolt heads are retained by said bolt retainers, and said knob nuts threadably engage said threaded ends of said bolts.

40. The basketball standard of claim 39, wherein said shafts substantially resist removal by hand from said aligned bolt holes if said pole is in a stationary, substantially upward inclined position, and said shafts do not substantially resist removal by hand from said aligned bolt holes if said pole is in a substantially horizontal position.

41. The basketball standard of claim 31, wherein said pole is fixable at a predetermined length which gives the portable basketball system a total height of less than about nine feet.

42. The basketball standard of claim 31, wherein said pole is fixable at a plurality of predetermined lengths which give the portable basketball system goal heights in the range from about seven-and-one-half feet to about ten feet.

* * * * *